US010006605B2

(12) United States Patent
Zhang et al.

(10) Patent No.: US 10,006,605 B2
(45) Date of Patent: Jun. 26, 2018

(54) OPTICAL AND MECHANICAL ASSEMBLY FOR WALL WASH LIGHTING

(71) Applicant: ABL IP Holding LLC, Decatur, GA (US)

(72) Inventors: Chi Zhang, Evanston, IL (US); Aaron P. Fryzek, Wheaton, IL (US)

(73) Assignee: ABL IP Holding LLC, Atlanta, GA (US)

( * ) Notice: Subject to any disclaimer, the term of this patent is extended or adjusted under 35 U.S.C. 154(b) by 633 days.

(21) Appl. No.: 14/624,628

(22) Filed: Feb. 18, 2015

(65) Prior Publication Data

US 2015/0241027 A1 Aug. 27, 2015

Related U.S. Application Data

(60) Provisional application No. 61/945,365, filed on Feb. 27, 2014.

(51) Int. Cl.
*F21V 7/00* (2006.01)
*F21S 8/02* (2006.01)
(Continued)

(52) U.S. Cl.
CPC ..... *F21V 7/0033* (2013.01); *F21S 8/026* (2013.01); *F21V 5/046* (2013.01); *F21V 13/04* (2013.01); *F21Y 2115/10* (2016.08)

(58) Field of Classification Search
CPC ..... F21V 7/0033; F21V 13/04; F21V 17/12; F21V 21/049; F21V 21/03
(Continued)

(56) References Cited

U.S. PATENT DOCUMENTS 4,475,147 A * 10/1984 Kristofek ..... F21S 8/026 362/147
5,530,628 A * 6/1996 Ngai ..... F21V 5/02 362/127
(Continued)

FOREIGN PATENT DOCUMENTS

CA 2882783 8/2015
MX 2015002444 8/2015

OTHER PUBLICATIONS

Office Action for Mexican Application No. MX/A/2015/002444 (2 pages English Translation; 2 pages MX OA), dated Dec. 5, 2016, 4 pages.
(Continued)

*Primary Examiner* — William N Harris
(74) *Attorney, Agent, or Firm* — Kilpatrick Townsend & Stockton, LLP

(57) ABSTRACT

A wall wash lighting assembly is provided for a recessed light fixture mountable on a ceiling. The lighting assembly includes an optical assembly and a trim face plate connected thereto. The optical assembly has a first kicker reflector, a second kicker reflector and a light-shaping optical film. The first kicker reflector reflects light from a light source. The second kicker reflector reflects light received from the first kicker reflector toward an adjacent wall. The light-shaping optical film spreads light from the light source and the first and second kicker reflectors in a uniform light pattern in a target area, such as onto the adjacent wall or downward in a direction parallel to the adjacent wall. The trim face plate has a trim opening through which light is outputted onto the target area. The lighting assembly can employ detachable fasteners to allow for the interchangeability of the optical film and the trim face plate.

21 Claims, 7 Drawing Sheets

(51) Int. Cl.
*F21V 5/04* (2006.01)
*F21V 13/04* (2006.01)
*F21Y 115/10* (2016.01)

(58) Field of Classification Search
USPC ..... 362/147, 300
See application file for complete search history.

(56) References Cited

U.S. PATENT DOCUMENTS 6,632,006 B1 * 10/2003 Rippel ..... F21S 8/02 362/147
6,698,912 B2 * 3/2004 Yang ..... B60Q 1/0052 362/240
6,994,456 B1 * 2/2006 Russo ..... F21S 8/02 362/147
7,384,167 B1 * 6/2008 Gamache ..... F21S 8/02 362/147
8,038,321 B1 * 10/2011 Franck ..... F21S 8/026 362/249.02
8,152,342 B2 * 4/2012 Jowid ..... F21S 8/02 362/145
8,770,779 B2 7/2014 Steadman et al.
9,052,081 B1 * 6/2015 Paulsel ..... F21V 17/002
9,234,640 B2 * 1/2016 Geralds ..... F21S 8/026
9,388,958 B2 * 7/2016 Watson ..... F21V 7/00
2012/0140463 A1 6/2012 Kinzer et al.
2016/0320008 A1 11/2016 Chen et al.
2016/0320022 A1 11/2016 Chen et al.

OTHER PUBLICATIONS

Office Action for Canadian Application No. CA 2,928,385, dated Feb. 15, 2017, (3 pages).

Office Action CA 2,882,783, dated Feb. 2, 2018, 3 pages.

* cited by examiner

OPTICAL AND MECHANICAL ASSEMBLY FOR WALL WASH LIGHTING

RELATED CASES

The present application claims priority under 35 U.S.C. § 119(e) based on U.S. Provisional Application Ser. No. 61/945,365 filed on Feb. 27, 2014, which is incorporated by reference herein in its entirety.

FIELD

The present disclosure is related to a recessed light fixture, and more particularly, to a wall wash lighting assembly for a recessed light fixture.

BACKGROUND

A downlight wall wash is a type of recessed light fixture, which is mounted in a ceiling. The wall wash is used to distribute light onto a wall that is adjacent to the light fixture. Lighting designers use various criteria to evaluate the quality of such a light fixture, such as how well the fixture can distribute light on the adjacent wall. Ideally, lighting designers would like to have the light distributed evenly on the wall with the light directed very close to the ceiling and a smooth transition down the wall toward the floor. Multiple wall washers, which are arranged next to each other, can be used to eliminate arch type of distribution (called scallops) and create a wall pattern that is very uniform horizontally across the wall and vertically, with no variation in foot candles.

Light-emitting diodes (LEDs) have become a viable light source for downlights. However, manufacturers continue to design wall wash reflectors using the same type of configurations and shapes that are used with a traditional light source that generates light in all directions. There are two commonly used approaches to perform wall-wash. For example, the first approach is to use a wall wash lighting assembly that consists of a parabolic trim with a window cut out and replaced with a redirecting partial parabolic kicker. The first approach has the benefits of a suitably high-ceiling illumination but suffers from uniformity distribution on the adjacent wall. For example, as shown in FIG. 6, the light distributed on an adjacent wall has a large gradient of light to dark resulting in poor uniformity. The second approach is to use a wall wash lighting assembly that consists of an angle-cut trim and a linear spread lens. The angle cut trim is used to aim light toward the adjacent wall, and the linear spread lens is used to distribute light evenly on the wall. The second approach is, however, unable to provide for a high-ceiling illumination, as shown in FIG. 7.

SUMMARY

To address these and other shortcomings, an improved wall wash lighting assembly is provided for a recessed light fixture, which is mountable in a ceiling. The wall wash lighting assembly can include an optical assembly and a trim face plate mechanically connected thereto. The optical assembly has a first kicker reflector, a second kicker reflector and a light-shaping optical film. The first kicker reflector reflects light from a light source, such as an LED light source. The second kicker reflector reflects light received from the first kicker reflector toward an adjacent wall. The light-shaping optical film spreads any light received from the light source and the first and second kicker reflectors in a uniform light pattern onto a target area, such as onto the adjacent wall or in a downward direction parallel to the adjacent wall. The trim face plate has a trim opening through which light is outputted onto the target area. The trim face plate can be an angle-cut trim face plate. The combination of these components allows for the design of a wall wash lighting assembly that is compact and can distribute light evenly onto an adjacent wall for any trim aperture size.

The first and second kicker reflectors can have different types of reflective surfaces. For example, the first kicker reflector can have a reflective metallized finish, and the second kicker reflector can have a reflective white finish. The reflective white finish of the second kicker reflector can diffuse, as well as reflect, the received light to help smooth the light pattern on the adjacent wall.

Furthermore, the wall wash lighting assembly can utilize detachable fasteners to allow for the interchangeability of components in the lighting assembly. For example, the optical assembly can be detachably connected to the trim face plate, e.g. at bosses on the trim face plate, using fasteners such as a screw(s). In this way, different types of interchangeable trim face plates can be used in combination with the optical assembly. The trim face plates can have different aesthetic features (e.g., square or round) or different optical features (e.g., an angle-cut trim to reduce glare, or a non-angle-cut trim). The same fasteners can also be used to connect mounting springs to the bosses on the trim face plate. The mounting springs are used to mount the optical assembly and trim face plate into a housing or mounting frame of the recessed light fixture.

Similarly, the optical film can also be detachably connected to at least one of the kicker reflectors of the optical assembly or the trim face plate, using detachable fasteners such as a screw(s). In this way, different types of interchangeable optical films, such as those with different light patterns, can be used in the wall wash lighting assembly to provide for a desired uniform light pattern on the adjacent wall or in a direction parallel to the adjacent wall. For example, it is possible to configure a different light beam distribution horizontally on the wall, by simply replacing the optical film, e.g., switching a 90×1 degree film to a 60×1 degree film. The wall wash lighting assembly can provide a wider uniform light beam distribution with a 90×1 degree film, or a narrower uniform light beam distribution with a 60×1 degree film.

BRIEF DESCRIPTION OF THE DRAWINGS

The description of the various exemplary embodiments is explained in conjunction with the appended drawings, in which.

DETAILED DESCRIPTION OF THE EXAMPLE EMBODIMENTS

Figure 1:
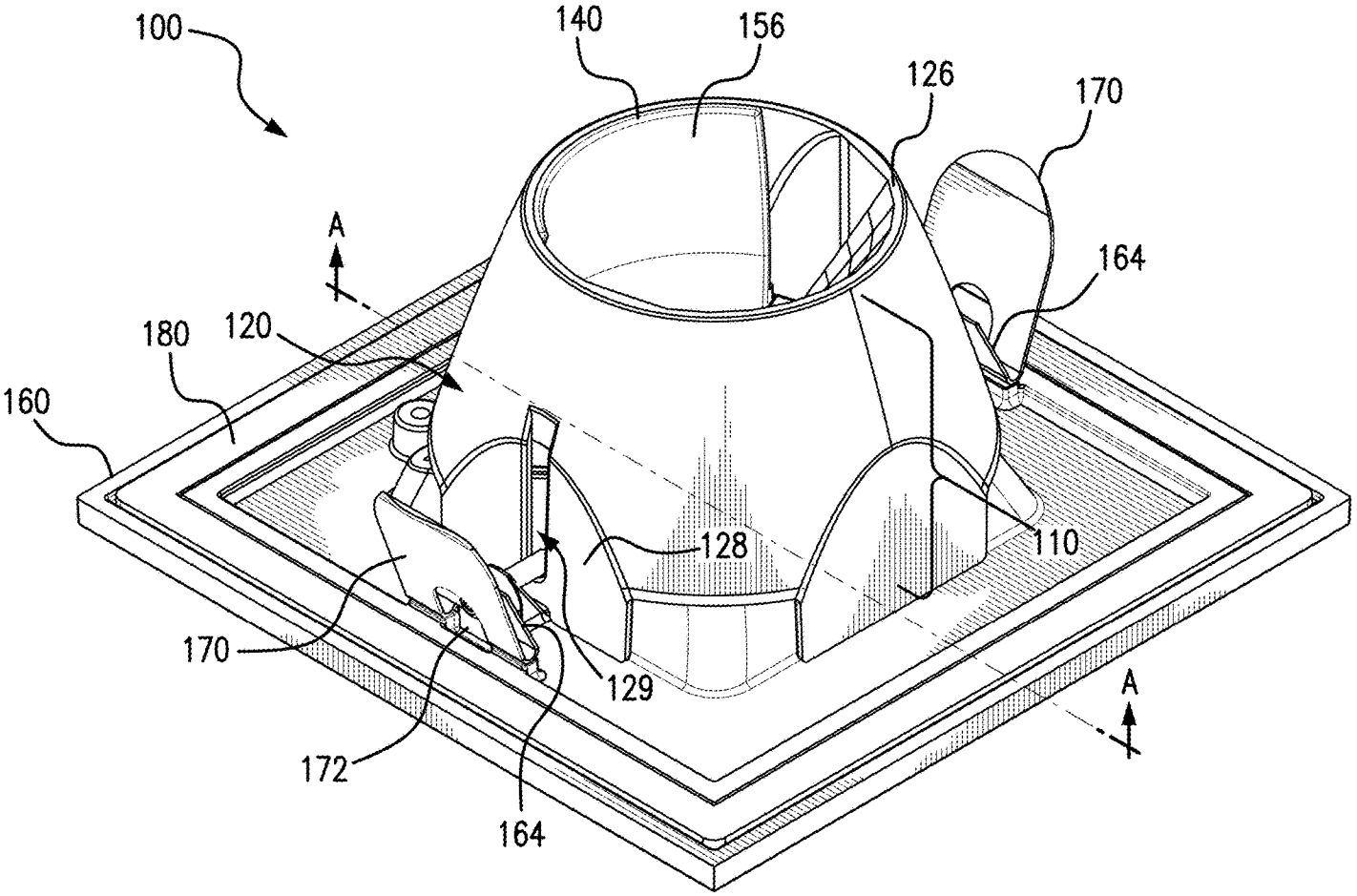
FIG. 1 illustrates a perspective view of an assembled wall wash lighting assembly for a recessed light fixture, in accordance with an exemplary embodiment of the present disclosure.

FIG. 1 illustrates a wall wash lighting assembly 100 for a recessed light fixture, which is mountable in a ceiling. The wall wash lighting assembly 100 includes an optical assembly 110 and a trim face plate 160. The optical assembly 110 includes a first kicker reflector 120, an optical film 130 (not shown), and a second kicker reflector 140. The optical assembly 110 is detachably connected to the trim face plate 160 and mounting springs 170 using detachable fasteners 172, such as screws. The mounting springs 170 are used to mount the wall wash lighting assembly 100 into the ceiling, such as onto a housing or mounting frame of a recessed light fixture. The wall wash lighting assembly 100 can also include a gasket 180 to reduce or prevent light leakage between the trim face plate 160 and a room side of the ceiling, when the wall wash lighting assembly 100 is mounted in the ceiling. The various components of the wall wash lighting assembly 100 are shown in greater detail in the exploded view of FIG. 2.

Figure 2:
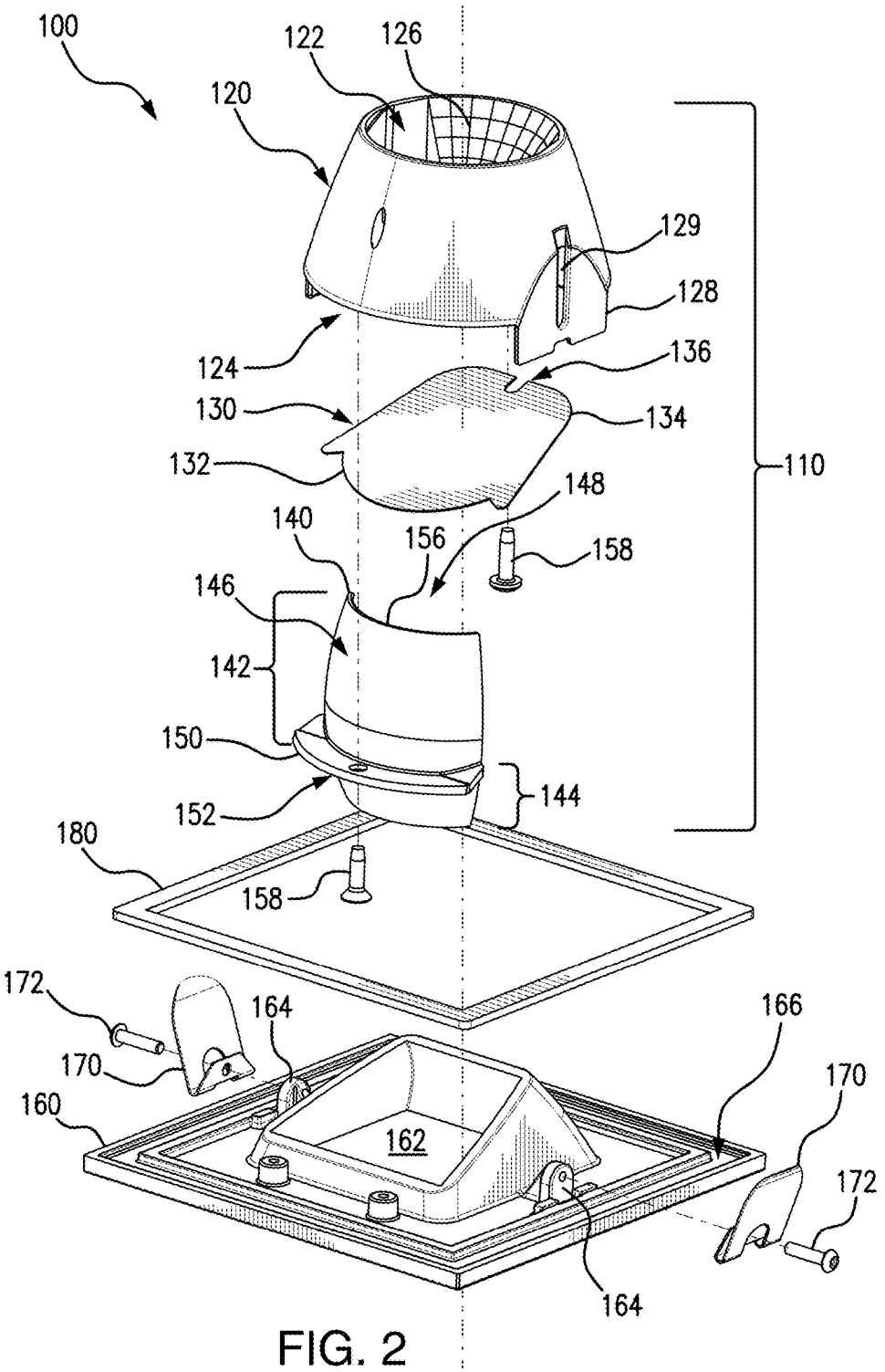
FIG. 2 illustrates an exploded view of the example components of the wall wash lighting assembly of FIG. 1.

As shown in FIG. 2, the first kicker reflector 120 has an upper opening 122, a lower opening 124 and a first reflective surface 126 to reflect light from a light source, such as a LED light source. The first kicker reflector 120 also includes a plurality of support tabs 128 on an exterior surface of the first kicker reflector 120. Each support tab 128 has a retaining slot 129 to receive a detachable fastener 172, such as a screw. In this example, the first kicker reflector 120 has a substantially frustoconical shape in which the upper opening 122 is smaller than the lower opening 124, and a pair of the support tabs 128. The two support tabs 128 are arranged on opposite sides of the first kicker reflector 120, and support the first kicker reflector 120 on the trim face plate 160. The first reflective surface 126 is a faceted surface, which has a reflective metallized finish. The first reflective surface 126 can have a partial parabolic or spherical shape.

The optical film 130 is an interchangeable light-shaping and diffusing optical film, which can be used to shape and control a light pattern, such as on an adjacent wall and/or downward toward a floor in a direction parallel to the adjacent wall. Thus, the optical film 130 can be selected with desired light beam distribution properties, e.g., horizontal width of the light beam distribution, according to the lighting application. For example, the optical film 130 can be a 90×1 degree film for a wider horizontal light beam distribution or a 60×1 degree film for a narrower horizontal light beam distribution. The optical film 130 can have microscopic patterned elements laminated to a polycarbonate film carrier. As shown in FIG. 2, the optical film 130 has a first end 132 and a second end 134. The second end 134 includes a fastener slot 136 to receive a detachable fastener 158, such as a screw.

The second kicker reflector 140 has an upper portion 142 and a lower portion 144. The second kicker reflector 140 also has a first side 146 and an opposing second side 148. The second side 148 has a second reflective surface 156 to reflect light toward an adjacent wall. The second reflective surface can have a reflective white finish, which can diffuse, as well as reflect, light to help smooth the light pattern on a target area, e.g., on the adjacent wall and downward toward a floor. The second kicker reflector 140 can also include a first ledge 150 extending from the first side 146. The first ledge 150 has a fastener hole 152 to receive a detachable fastener 158, such as a screw. The second kicker reflector 140 also includes a second ledge 154 (not shown) extending from the second side 148 to support the first end 132 of the optical film 130. In this example, the second kicker reflector 140 along with the second reflective surface 156 can have a partial parabolic or spherical shape.

The trim face plate 160 includes a trim opening 162 through which light from the optical assembly 110 is directed onto a target area, such as on an adjacent wall and/or downward toward a floor in a direction parallel to the adjacent wall. The trim face plate 160 includes two bosses 164. Each of the bosses 164 is arranged on opposite sides of the trim opening 162 around a periphery of the trim opening 162. The trim face plate 160 also includes a gasket groove 166 for the gasket 180 to reduce or eliminate light leakage from the edge of the trim face plate 160, when mounted onto a ceiling. The gasket groove 166 extends continuously around a periphery of the trim face plate 160. In this example, the trim face plate 160 is rectangular (e.g., square) and has an angle cut opening with a parabolic shape to reduce glare.

The wall wash lighting assembly 100 incorporates a detachable retaining assembly, which employs detachable fasteners (e.g., 158, 172), such as screws, to allow the optical assembly 110 to be detachably connected to the trim face plate 160, and the optical components (e.g., the first kicker reflector 120, optical film 130 and second kicker reflector 140) to be detachably connected to each other. In this way, the wall wash lighting assembly 100 can be easily disassembled, if desired, to switch out and change the trim face plate 160 or the optical film 130.

For example, the trim face plate 160 can have different aesthetic features (e.g., rectangular or round) or different optical features (e.g., an angle-cut trim to reduce glare, or a non-angle-cut trim). Similarly, different types of interchangeable optical films, such as those with different light patterns, can be used in the wall wash lighting assembly 100 to provide for a desired uniform light pattern on the adjacent wall or downward in a direction parallel to the adjacent wall. Furthermore, as previously discussed, it is possible to configure a different light beam distribution horizontally on the wall, by simply replacing the optical film, e.g., switching 90×1 degree film to 60×1 degree film.

Furthermore, the same detachable fasteners 172 can also be used to connect the mounting springs 170 to respective bosses 164 on the trim face plate 160. The mounting springs 170 are used to mount the optical assembly and trim face plate into a housing or mounting frame of a recessed light fixture. In this example, the wall wash lighting assembly 100 includes two mounting springs 170.

Figure 3:
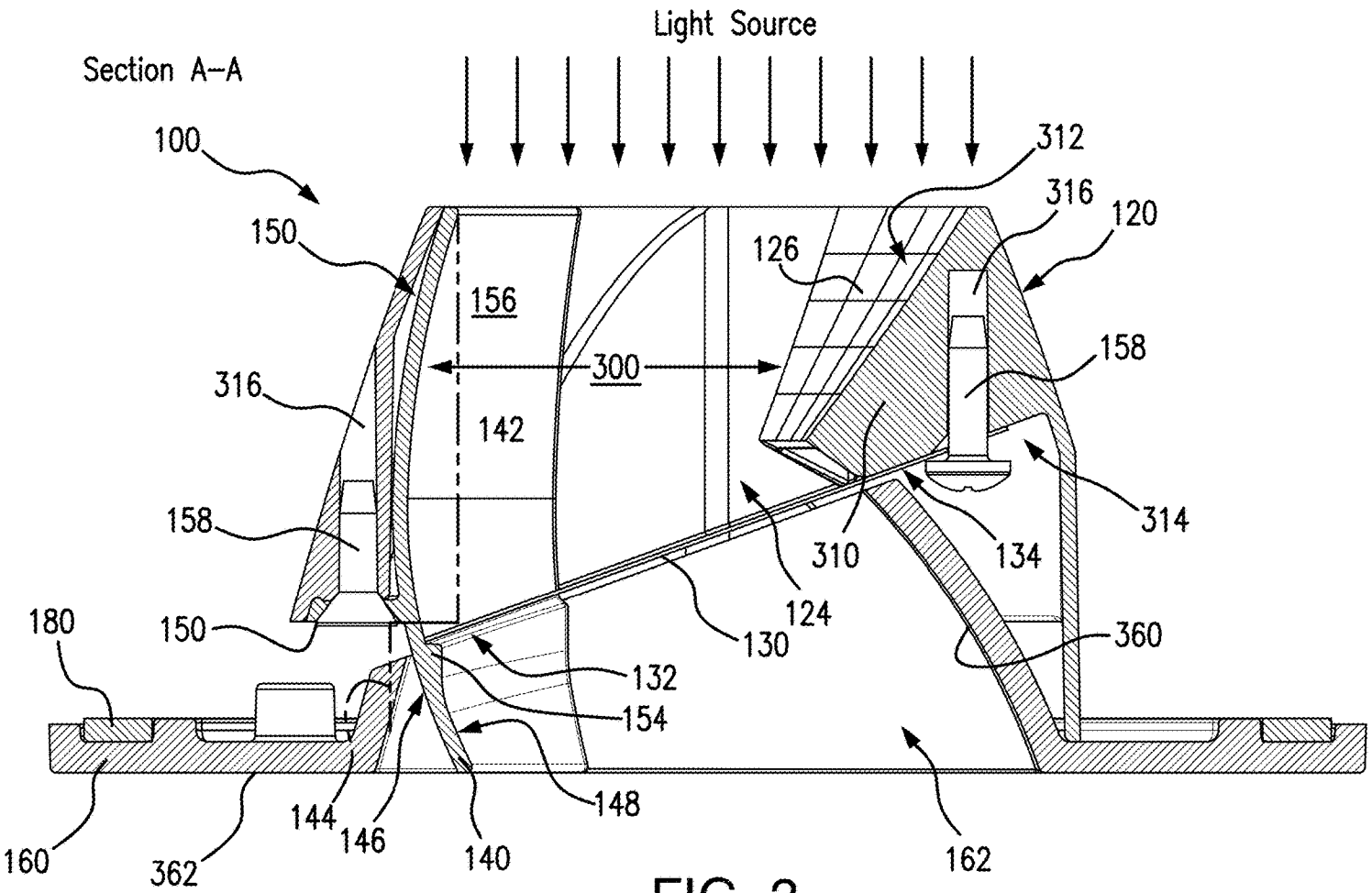
FIG. 3 illustrates a cross-sectional view of the assembled wall wash lighting assembly of FIG. 1 along Section A-A.

FIG. 3 illustrates a cross-sectional view of the assembled wall wash lighting assembly 100 of FIG. 1. When assembled, the upper portion 142 of the second kicker reflector 140 is arranged inside of a cavity 300 of the first kicker reflector 120, with the first ledge 150 abutting a bottom of the first kicker reflector 120 (e.g., a bottom groove) and connected thereto with a detachable fastener 158. The second reflective surface 156 on the upper portion 142 is generally positioned opposite the first reflective surface 126 to receive light, which is reflected from the first reflective surface 126.

As shown in greater detail in FIG. 3, the first kicker reflector 120 has a downward sloping projection 310, which extends from around the upper opening 122 toward the lower opening 124 in the cavity 300 of the first kicker reflector 120. The projection 310 has a top surface 312 and a bottom surface 314. The top surface 312 faces the upper opening 122 of the first kicker reflector 120, and includes the first reflective surface 126. The bottom surface 314 faces the lower opening 124 of the first kicker reflector 120, and includes a fastener hole 316 to receive a detachable fastener 158.

The optical film 130 has the first end 132 supported on the second ledge 154 of the second kicker reflector 140. The second end 134 of the optical film 130 is fastened to the bottom surface 314 of the projection 310 of the first kicker reflector 120 using a detachable fastener 158, which extends through the fastener slot 136 of the optical film 130 and into the fastener hole 316 of the first kicker reflector 120. In this example, the optical film 130 is tilted at an angle, which corresponds to the angle of the angle cut of the trim face plate 160. Furthermore, the dimension of the projection 310 is configured to match the parabolic angle-cut portion 360 of the trim face plate 160 which extends into the cavity 300 of the first kicker reflector 120.

The wall wash lighting assembly 100 is easy to assemble and disassemble. Referring to FIGS. 2 and 3, to assemble the wall wash lighting assembly 100, the optical components of the optical assembly 110 (such as the first kicker reflector 120, the optical film 130 and the second kicker reflector 140) are connected together using the detachable fasteners 158. The optical assembly 110, the trim face plate 160 and the mounting springs 170 are subsequently connected using the detachable fasteners 172. The wall wash lighting assembly 100 can be disassembled by detaching the detachable fasteners 172, and then detaching the detachable fasteners 158 in the reverse order. In this way, as previously discussed, the components of the wall wash lighting assembly 100, such as the optical film 130 and the trim face plate 160, can be easily replaced or switched out.

Figure 4:
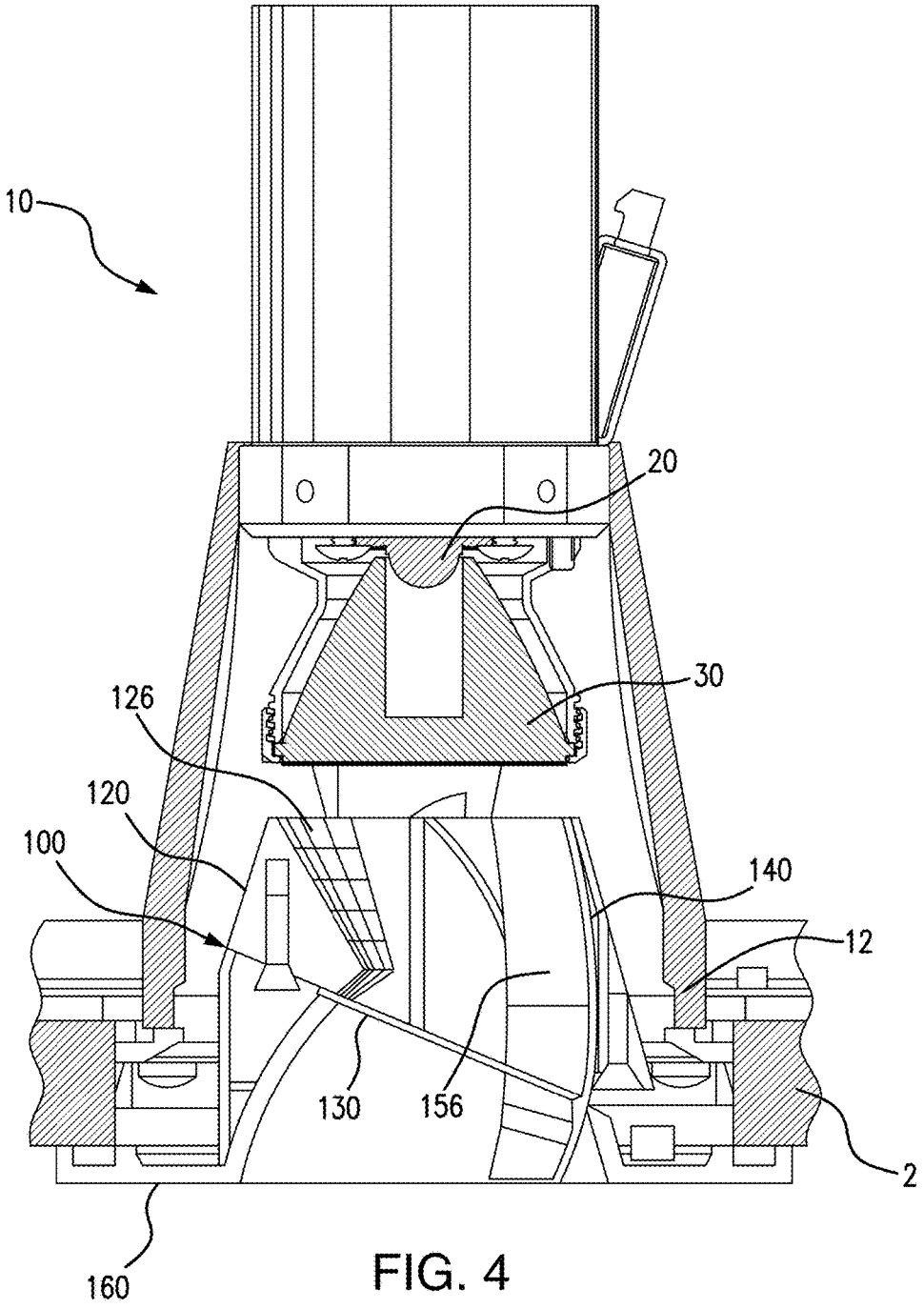
FIG. 4 illustrates a perspective view of a recessed light fixture including a light source, a primary reflector, and the wall wash lighting assembly of FIGS. 1-3, which are all mounted to a ceiling.

FIG. 4 illustrates a perspective view of a recessed light fixture 10 including a light source (e.g., a LED light source) 20, a primary TIR (total internal reflection) lens 30, and the wall wash lighting assembly 100 of FIGS. 1-3, all of which are mounted to a ceiling 2. The wall wash lighting assembly 100 is mounted onto a housing or mounting frame 12 of the recessed light fixture 10, through a ceiling hole in the ceiling 2, using the mounting springs 170 (see e.g., FIGS. 1 and 2).

Referring to FIGS. 3 and 4, in an example operation, light from the light source 20 is directed through the upper opening 122 and into the cavity 300 of the first kicker reflector 120. Some of the light passes straight down through the optical film 130 and out from the lower opening 124 and trim opening 162 in a downward direction, which is parallel to an adjacent wall, toward a floor. Some of the light is also reflected off of the first reflective surface 126 toward the second reflective surface 156 on the upper portion 142 of the second kicker reflector 140. The second reflective surface 156, in turn, reflects the light received from the first reflective surface 126 and any light directly from the light source toward the adjacent wall. To provide for high-ceiling illumination on the adjacent wall, the second reflective surface 156 on the lower portion 144 is arranged in the trim opening of the trim face plate 160 in proximity to a room side 362 of the trim face plate 160. The optical film 130 extends across the cavity 300 to diffuse, shape and control all light passing through the cavity (e.g., direct or reflected light) and out the trim opening 162 to provide a uniform light pattern on the adjacent wall and/or downward in a direction in parallel to the adjacent wall toward the floor. The angle-cut portion 360 of the trim face plate 160 has a parabolic profile, which acts to reduce glare from the wall wash lighting assembly 100.

Figure 5:
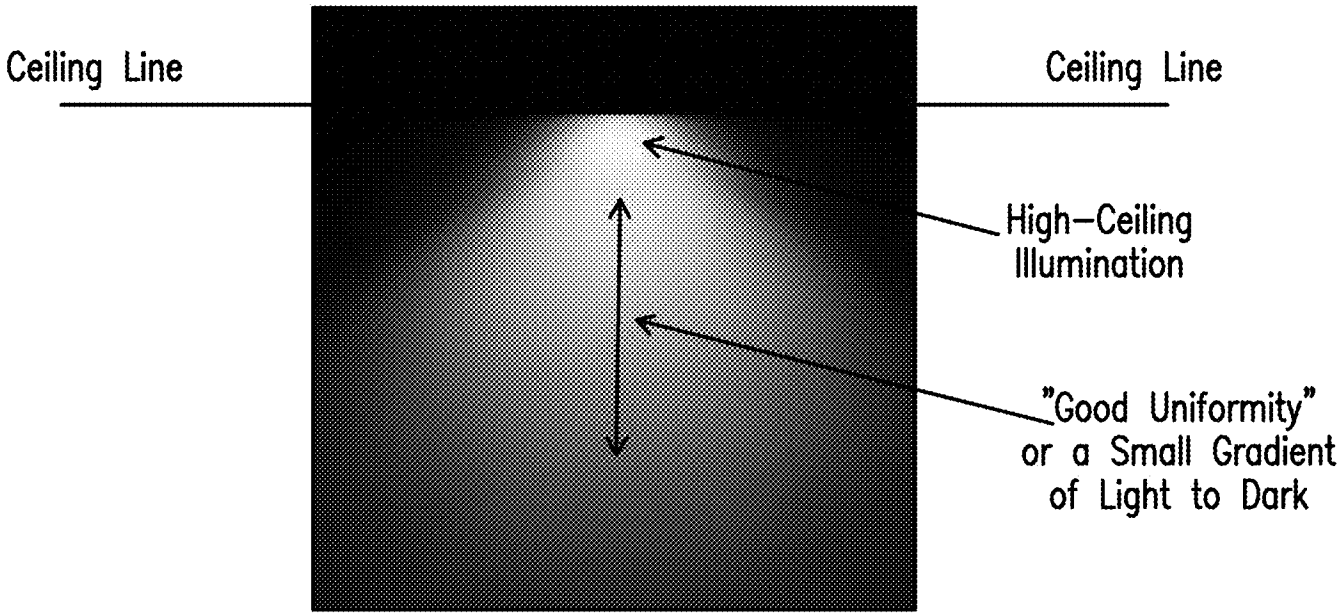
FIG. 5 illustrates an example light pattern distribution for a recessed light fixture with the wall wash lighting assembly of FIGS. 1-4, in accordance with an exemplary embodiment.
Figure 6:
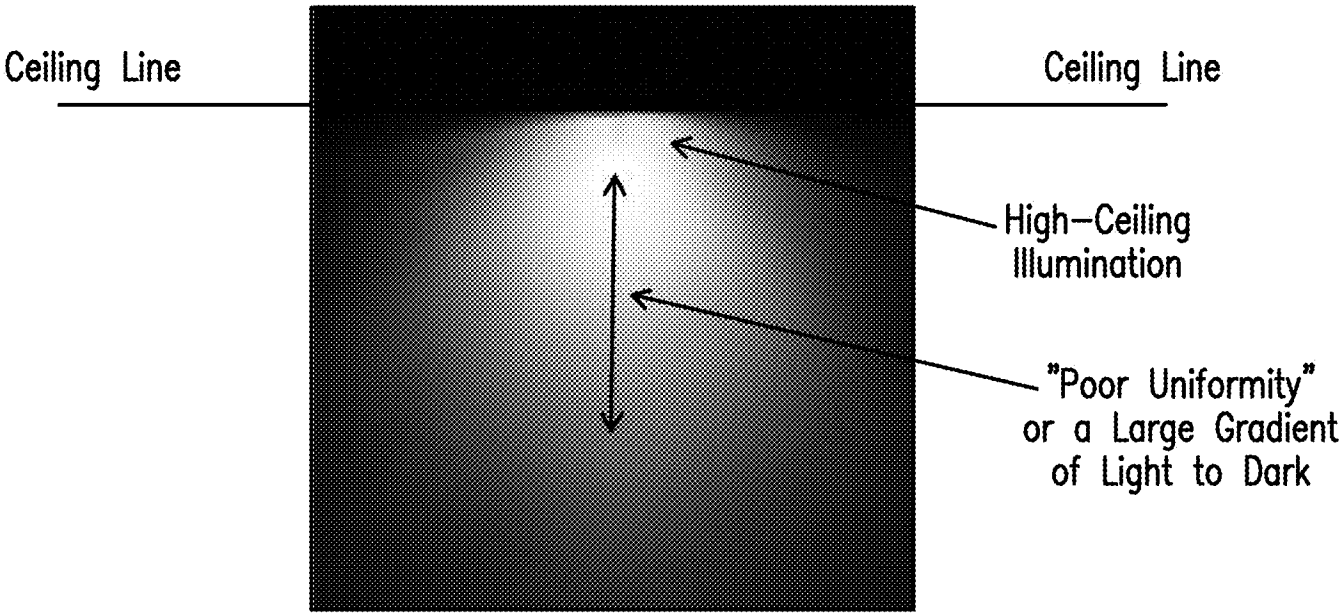
FIG. 6 illustrates an example light pattern distribution for a recessed light fixture with a wall wash lighting assembly consisting of a parabolic trim with a window cut out and replaced with a redirecting partial parabolic kicker.
Figure 7:
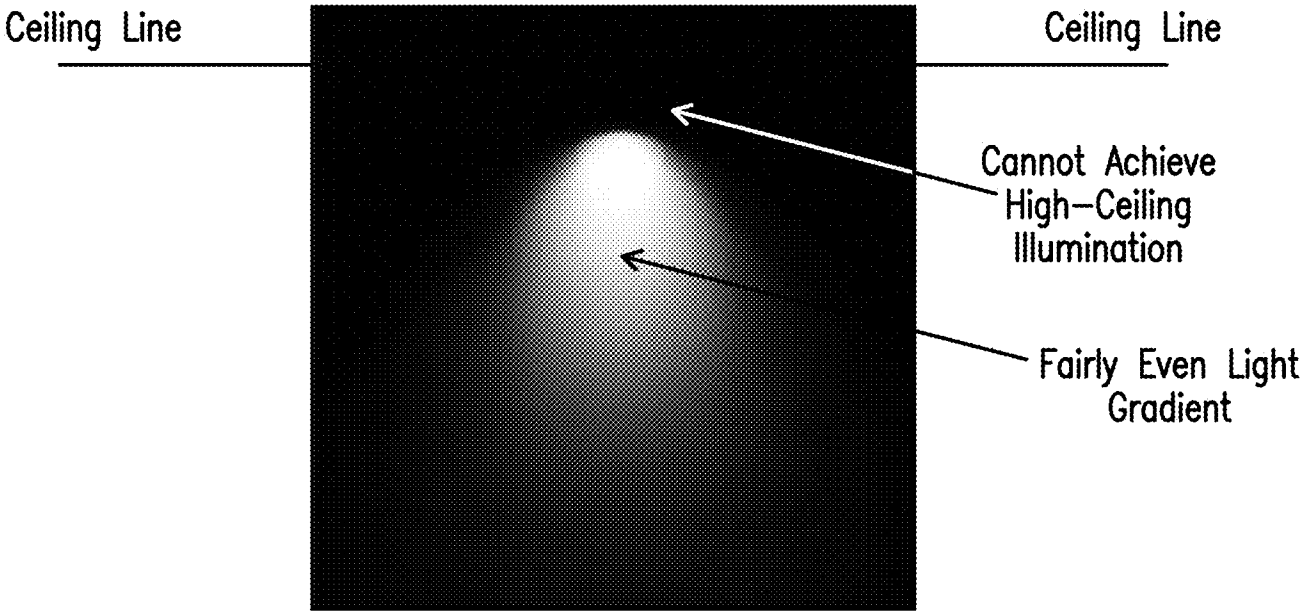
FIG. 7 illustrates an example light pattern distribution for a recessed light fixture with a wall wash lighting assembly that consists of an angle-cut trim and a linear spread lens.

FIG. 5 illustrates an example light pattern distribution for a recessed light fixture with the wall wash lighting assembly 100 of FIGS. 1-4. As shown in FIG. 5, the wall wash lighting assembly 100 is able to provide for high-ceiling illumination on the adjacent wall, while at the same time providing a uniform light pattern on the adjacent wall and downward toward the floor.

The wall wash lighting assembly 100 is provided as an example. The dimension and shape of the various components can be modified as desired according to the lighting application. A different type of trim face plate can be used other than a square or angle cut trim face plate, with different aesthetic shape and optical features. Instead of being tilted, the optical film can be arranged substantially parallel to the trim opening or aperture in a cavity of the wall wash lighting assembly. The optical film can be connected to the kicker reflector(s) or the trim, using detachable fastener(s) such as screws. The optical film can have any suitable shape which extends across a cavity of the trim, to diffuse, shape and control all of the light passing through the trim to produce a uniform light pattern in a target area. The size and shape of the reflective surfaces of the first and second kicker reflectors can also be modified (e.g., parabolic, spherical, etc.).

Words of degree, such as "about", "substantially", and the like are used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the invention.

The invention claimed is:

1. A wall wash lighting assembly for a recessed light fixture that includes a light source and is mountable in a ceiling, the wall wash lighting assembly comprising:

an optical assembly including:

a first kicker reflector to reflect light from the light source, wherein:

the first kicker reflector forms an upper opening and a lower opening at respective upper and lower ends of a cavity that extends from the upper opening to the lower opening, and the optical assembly receives light from the light source, through the upper opening into the cavity;

a second kicker reflector to reflect light received from the first kicker reflector toward an adjacent wall, and a light-shaping optical film to spread light received from the light source, the first kicker reflector and the second kicker reflector onto the adjacent wall or downwardly from the wall wash lighting assembly; and a trim face plate connected to the optical assembly, the trim face plate having a trim opening through which light is outputted onto the adjacent wall or downwardly from the wall wash lighting assembly;

wherein the first kicker reflector extends downwardly from the upper end of the cavity toward the second kicker reflector so that a first reflective surface of the first kicker reflector is upwardly facing and reflects a first portion of the light that enters from the light source, across the cavity.

2. The wall wash lighting assembly of claim 1, wherein the first kicker reflector, the second kicker reflector and the optical film are detachably connected to each other with a plurality of detachable fasteners.

3. The wall wash lighting assembly of claim 1, wherein the optical assembly is detachably connected to the trim face plate with a detachable fastener.

4. The wall wash lighting assembly of claim 1, wherein:

the second kicker reflector includes a second reflective surface that reflects at least part of the first portion of the light toward the adjacent wall; and at least a portion of the second reflective surface of the second kicker reflector is disposed within the cavity of the first kicker reflector.

5. The wall wash lighting assembly of claim 4, wherein the first kicker reflector has a substantially frustoconical shape to receive light from the light source through the upper opening.

6. A wall wash lighting assembly for a recessed light fixture that is mountable in a ceiling, comprising:

an optical assembly including:

a first kicker reflector to reflect light from a light source, wherein:

the first kicker reflector has an upper opening, a lower opening and a cavity therebetween, the first kicker reflector further having a first reflective surface arranged in the cavity to reflect light from the light source, and a second kicker reflector to reflect light received from the first kicker reflector toward an adjacent wall, wherein the second kicker reflector is connectable to the first kicker reflector, the second kicker reflector including a second reflective surface to reflect light from the first reflective surface of the first kicker reflector toward the adjacent wall, a portion of the second reflective surface of the second kicker reflector being arranged in the cavity of the first kicker reflector, and a light-shaping optical film to spread light received from the light source, the first kicker reflector and the second kicker reflector in a uniform light pattern onto the adjacent wall or in a direction parallel to the adjacent wall; and a trim face plate connected to the optical assembly, the trim face plate having a trim opening through which light is outputted onto the adjacent wall or downwardly in a direction parallel to the adjacent wall;

wherein the first kicker reflector includes two retaining slots and the trim face plate includes two bosses arranged proximate to a periphery of the trim opening, each of the bosses being connected to the first kicker reflector through a respective retaining slot using a detachable fastener.

7. The wall wash lighting assembly of claim 6, further including a mounting spring, connected to each of the bosses of the trim face plate via a detachable fastener, to mount the trim face place and the optical assembly in a housing or mounting frame.

8. The wall wash lighting assembly of claim 6, wherein the first kicker reflector includes two support tabs which are connected on opposing exterior sides of the first kicker reflector to support the kicker reflector on the trim face place, each of the two tabs including a respective one of the two retaining slots.

9. The wall wash lighting assembly of claim 6, wherein the second reflective surface of the second kicker reflector is substantially spherical.

10. The wall wash lighting assembly of claim 9, wherein the second kicker reflector has a first side and an opposing second side with the second reflective surface, the first side including a first ledge to abut against a bottom of the first kicker reflector proximate the lower opening, the second side including a second ledge to support a portion of the optical film thereon.

11. The wall wash lighting assembly of claim 10, wherein the first ledge of the second kicker reflector is fastened against the bottom of the first kicker reflector with a detachable fastener.

12. The wall wash lighting assembly of claim 10 wherein:

the first kicker reflector includes a downward sloping projection in the cavity, the projection having a top surface and a bottom surface, the top surface including the first reflective surface, the bottom surface facing the lower opening of the first kicker reflector, and the optical film includes a first end and an opposing second end, the first end being supported on the second ledge of the second kicker reflector, the second end being fastened to the bottom surface of the downward sloping projection of the first kicker reflector.

13. The wall wash lighting assembly of claim 12, wherein the optical film includes a fastener slot on the second end through which to fasten, via a detachable fastener, the optical film to the bottom surface of the downward sloping projection of the first kicker reflector.

14. The wall wash lighting assembly of claim 1, wherein the trim face plate comprises an angle cut trim face plate with a parabolic profile to control glare, and the optical film is tilted at an angle corresponding to an angle cut of the angle cut trim face plate.

15. The wall wash lighting assembly of claim 1, wherein the first kicker reflector has a first reflective surface with a reflective metallized finish, and the second kicker reflector has a second reflective surface with a reflective white material.

16. The wall wash lighting assembly of claim 1, wherein the optical film is positioned between the first kicker reflector and the trim face plate.

17. The wall wash lighting assembly of claim 1, wherein the optical film includes a first end and an opposite second end, the first end being supported on the second kicker reflector and the second end being fastened to the first kicker reflector.

18. The wall wash lighting assembly of claim 1, wherein the second kicker reflector further diffuses light.

19. The wall wash lighting assembly of claim 4, wherein the second kicker reflector includes an upper portion and a lower portion, the upper portion being arranged opposite the first reflective surface of the first kicker reflector.

20. A wall wash lighting assembly for a recessed light fixture that includes a light source, and is mountable on a ceiling, the wall wash lighting assembly comprising:

an optical assembly including:

a first kicker reflector to reflect light from the light source, wherein:

the first kicker reflector forms an upper opening and a lower opening at respective upper and lower ends of a cavity that extends from the upper opening to the lower opening, the first kicker reflector forms an inward projection in the cavity below the upper opening, the inward projection having an upper surface and an underside;

the upper surface includes a first reflective surface, the underside continues from the upper surface to the lower opening of the first kicker reflector, and the optical assembly receives light from the light source into the cavity through the upper opening;

a second kicker reflector that includes upper and lower portions, wherein:

the upper portion reflects light received from the first kicker reflector toward an adjacent wall, and the second kicker reflector has a first side, and an opposing second side that forms a second reflective surface, the first side including a ledge at an upper end of the lower portion; and a light-shaping optical film to spread light received from the light source, the first kicker reflector and the second kicker reflector onto the adjacent wall or downwardly from the wall wash lighting assembly, wherein the optical film includes a first end and an opposing second end, the first end being supported on the ledge of the second kicker reflector, the second end being in contact with the underside of the first kicker reflector; and a trim face plate connected to the optical assembly, the trim face plate having a trim opening through which light is outputted onto the adjacent wall or downwardly from the wall wash lighting assembly.

21. The wall wash lighting assembly of claim 20, wherein:

the second reflective surface is disposed across the cavity from the first reflective surface;

the upper portion of the second reflective surface extends from the upper opening of the first kicker reflector to the lower opening of the first kicker reflector; and the inward projection extends downwardly from the upper opening and toward the second kicker reflector so that the first reflective surface reflects a portion of the light that is received from the light source across the cavity toward the second reflective surface.

* * * * *